US007540178B2

(12) United States Patent
Peter et al.

(10) Patent No.: US 7,540,178 B2
(45) Date of Patent: Jun. 2, 2009

(54) ROLLING INSTALLATION AND METHOD FOR PRODUCING METAL STRIPS

(75) Inventors: Martin Peter, Siegen (DE); Ulrich Patzelt, Hilchenbach (DE); Hans-Peter Richter, Friedewald (DE)

(73) Assignee: SMS Demag AG, Düsseldorf (DE)

( * ) Notice: Subject to any disclaimer, the term of this patent is extended or adjusted under 35 U.S.C. 154(b) by 273 days.

(21) Appl. No.: 11/662,248

(22) PCT Filed: Jul. 14, 2006

(86) PCT No.: PCT/EP2006/006910

§ 371 (c)(1),
(2), (4) Date: Mar. 7, 2007

(87) PCT Pub. No.: WO2007/009672

PCT Pub. Date: Jan. 25, 2007

(65) Prior Publication Data

US 2007/0266544 A1 Nov. 22, 2007

(30) Foreign Application Priority Data

Jul. 18, 2005 (DE) ..... 10 2005 034 031

(51) Int. Cl.
*B21B 37/58* (2006.01)

(52) U.S. Cl. ..... 72/11.8; 72/148; 72/229; 242/533.7

(58) Field of Classification Search ..... 72/9.2, 72/11.8, 146, 148, 229; 242/533, 533.7, 242/558, 559, 559.3, 560
See application file for complete search history.

(56) References Cited

U.S. PATENT DOCUMENTS 3,062,465 A 11/1962 Hunter (Continued)

FOREIGN PATENT DOCUMENTS

DE 1086656 8/1960

(Continued)

OTHER PUBLICATIONS

Search Report, Nov. 6, 2006.

*Primary Examiner*—Edward Tolan
(74) *Attorney, Agent, or Firm*—Abelman, Frayne & Schwab

(57) ABSTRACT

The invention relates to a rolling plant (100) and to a method for its operation. Known rolling plants (100) typically comprise a reversing stand (110) for rolling a metal strip (200) in a plurality of rolling operations until the metal strip has reached the desired thickness. The reversing stand (110) is typically assigned at least one reversing reel device (130), which has a reel mandrel (132), for temporarily storing the metal strip (200) after individual rolling operations. The known rolling plants (100) also have a sensor device for determining the thickness of the metal strip. In order to cost-effectively achieve high flexibility in the use of primary materials of different strip thicknesses, it is proposed according to the invention that the rolling plant has a winding sleeve exchange device (140) for placing a winding sleeve (134)onto the reel mandrel (132) before the metal strip (200) is temporarily stored and for removing the winding sleeve from the reel mandrel between two rolling operations when the thickness of the metal strip determined by the sensor device (120) is still greater than the desired thickness but is already lower than a predetermined thickness threshold value.

11 Claims, 3 Drawing Sheets

U.S. PATENT DOCUMENTS

| | | | | |
|---|---|---|---|---|
| 4,066,218 | A * | 1/1978 | Kamp | 242/473.6 |
| 5,251,835 | A * | 10/1993 | Kyytsonen | 242/533.2 |
| 6,264,133 | B1 * | 7/2001 | Herrmann | 242/559.3 |
| 6,354,534 | B1 | 3/2002 | Matsunagana | |
| 6,644,586 | B2 * | 11/2003 | Birke et al. | 242/527.4 |
| 6,685,130 | B2 * | 2/2004 | Stauber et al. | 242/533.8 |
| 2002/0121570 | A1 * | 9/2002 | Yermal | 242/530.3 |

FOREIGN PATENT DOCUMENTS

| | | |
|---|---|---|
| DE | 8711281 | 1/1988 |
| DE | 9624007 | 12/1997 |
| JP | 4006839 | 1/1979 |

* cited by examiner

ROLLING INSTALLATION AND METHOD FOR PRODUCING METAL STRIPS

The invention relates to a rolling installation and a method for producing a metal strip, with the rolling installation including a reversing stand for rolling the metal strip and at least one reversing reel associated with the reversing stand for intermittently storing the metal strip between separate rolling steps.

Basically, reels for winding and unwinding of a metal strip are known from the state of the art, e.g., from EP 0 082 326. A reel, which is disclosed therein, has a driven reel mandrel surrounded by an expandable drum for winding and unwinding of a strip-shaped material.

International application WO 03/00 22 478 A1 discloses a winding sleeve that is pushed on an expandable reel mandrel. When the winding sleeve is being pushed on, the reel mandrel is not expanded and has then a minimal diameter. After the sleeve has been pushed on, the reel mandrel is expanded, so that the pushed-on sleeve is fixedly mounted on the expanded reel mandrel, e.g., becomes clamped. For dismounting of the winding sleeve, the diameter of the mandrel is reduced, so that the sleeve can be removed. By pushing the sleeve onto the expandable reel mandrel, an increase of the sleeve diameter is achieved.

German Publication DE 1 752 241 discloses the use of such reels in connection with rolling installations. It is described there that typically, a reel is arranged in front of and/or behind of a rolling installation in order to wind the to-be-rolled metal strip thereonto during or after separate rolling steps and intermittently store it there, and later, again release it by unwinding.

Finally, state of the art discloses that reels having not only one but two reel mandrels having different diameters, are arranged in front of or behind a rolling installation, in particular a reversing stand. Initially, thick metal strips are firstly wound on reel mandrels with a larger diameter in order to prevent a danger of crack formation during bending. When the thickness of metal strips is reduced after several rolling steps, they advantageously are wound on reel mandrels having a smaller diameter in order to obtain a higher strip weight at the same dimensions.

The reels require respective reel drives and switching means in order to connect, in accordance with value of the thickness of a respective rolled metal strip, a suitable, because of its diameter, reel mandrel with a drive motor. Such reel drives, which are formed for driving at least two, spatially separated, reel mandrels, are large and more expensive than a reel drive for driving only one reel mandrel. Further, transportation devices are needed in order to transport a rolled metal strip from and to a reel located at a distance from the reversing stand.

Proceeding from this state of the art, the object of the invention is to so modify a known rolling installation with a reversing stand and a reversing reel and a known method for operating the rolling installation that handling and, in particular, winding of metal strips, the thickness of which changes within a mill range during the rolling process, with a reversing reel having only one reel mandrel, is possible.

This object is achieved by the subject matter of claim 1. To this end, a rolling installation includes a winding sleeve exchange device for pushing a winding sleeve onto the reel mandrel before an intermittent storage of the metal strip and for removing the winding sleeve between two further rolling steps when thickness of the metal strip, which is determined by the sensor device, is greater than a desired thickness but smaller than a predetermined thickness threshold.

The claimed exchange device provides for a rapid mounting and dismounting of a winding sleeve on a single reel mandrel of a reversing reel, if needed. More precisely, the winding sleeve exchange device enables to push the winding sleeve on a single reel mandrel of a reversing reel, if needed. More precisely, the winding sleeve exchange device enables to push the winding sleeve before a first rolling step to provide a greater diameter for winding of the metal strip when the to-be-rolled metal strip is still relative thick. Because of a larger diameter, metal strips with a larger thickness can be wound, without the danger of cracks even when they are formed of hard or brittle materials. Likewise, the winding strip exchange device enables, advantageously, removal of the winding sleeve from the reel mandrel between two rolling steps when the thickness of the to-be-rolled metal strip is still greater than the desired thickness but is already small enough so that winding onto a reduced diameter, without a danger of cracks, is possible. Such a thickness is represented by a predetermined thickness threshold. As soon as the thickness is smaller than the predetermined thickness threshold, the metal strip is preferably wound directly onto the reel mandrel that has a smaller diameter than the winding sleeve, because in this way, at the same outer diameter, a greater coil weight, compared to winding on the winding sleeve, is achieved.

The claimed use of the winding sleeve during operation of the rolling installation with a reversing stand enables to use advantageously of only one reversing reel with a simple reel drive for driving of only one reel mandrel. The investment costs and maintenance and operational costs are noticeably smaller with a reel having only one reel mandrel than when the reel includes a second mandrel with a second drive shaft and a correspondingly more complex reel drive.

The claimed winding sleeve exchange device provides advantageously for a greater flexibility when primary materials with larger thicknesses are used.

Precisely, during modernization of rolling installations which up to the present operated with reels with only one reel mandrel and were formed previously for handling of then metal strips, the claimed winding sleeve exchange device provides advantageously the possibility of gently winding, without large additional expenses, thicker materials, without danger of cracks.

Finally, the winding sleeve exchange device provides advantages not only during modernization of the existing rolling installation but also during planning of new rolling installations. Thus, it is not any more absolutely necessary to decide already at the design of a rolling installation whether later thicker metal strips, as primary material, could be used or not. The claimed winding sleeve exchange device can be provided later, if space is available, permitting the use of thicker metal strips as a primary material.

The winding sleeve is an exchangeable part, which provides for availability of winding sleeves with different winding diameters in order to be able to select a winding sleeve with a correspondingly suitable diameter in accordance with the thickness of the used primary material.

Advantageously, the winding sleeve has a clamping element for clamping an end of a metal strip to start the winding process. Advantageously, the clamping element can be adapted to different thicknesses of the to-be-clamped metal strip.

Advantageously, the winding sleeve exchange device includes a telescopic device for coaxial displacement of the winding sleeve from an intermittent position onto the reel mandrel and from the reel mandrel into the intermittent position.

Advantageously, the winding sleeve exchange device further has a pivoting device for pivoting the winding sleeve from an initial position into the intermittent position.

The above-mentioned object of the invention is further achieved with a method of producing a metal strip in a rolling installation. The advantages of the method correspond to the above-mentioned advantages discussed with reference to the claimed rolling installation.

Further advantageous embodiments of the rolling installation and the method form subject matter of sub-claims.

The description is accompanied with reference to four figures all in all, wherein.

Below, the invention will be described in detail in form of embodiment examples with reference to the above-mentioned figures.

Figure 1:
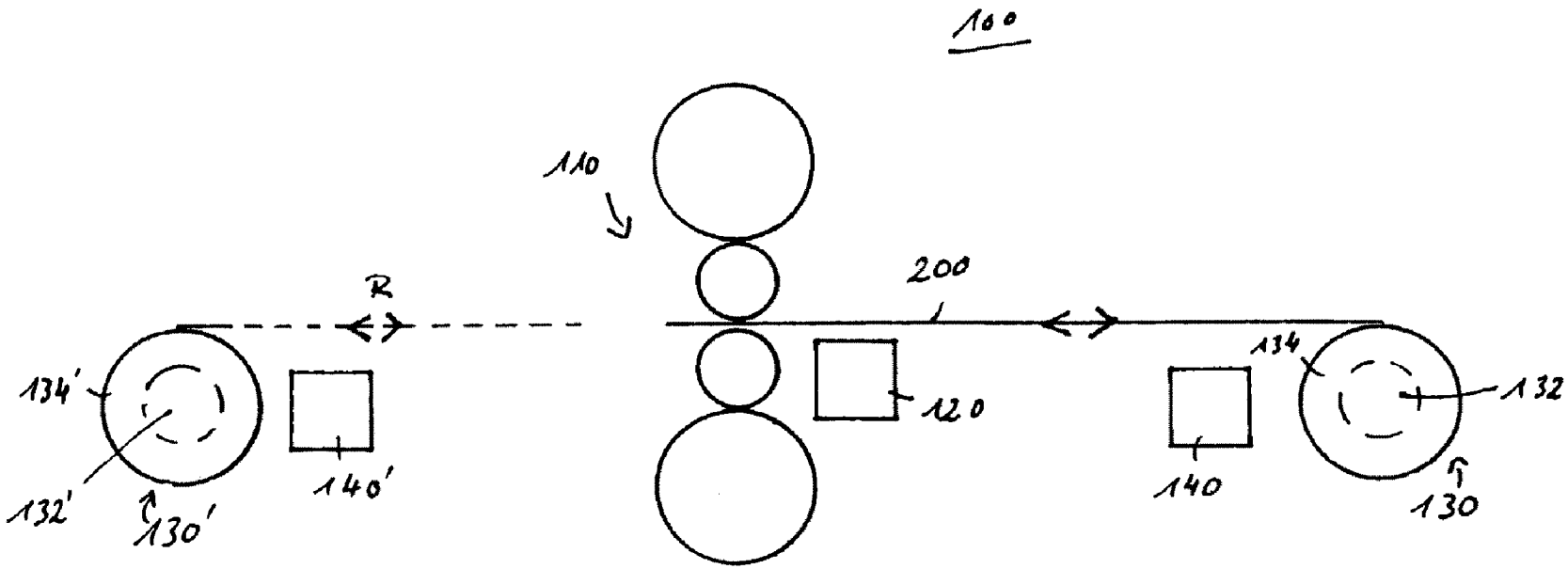
FIG. 1 shows a rolling installation.

FIG. 1 shows a rolling installation 100 according to the invention. The rolling installation serves for producing a metal strip 200. To this end the rolling installation has a reversing stand 110 for rolling the metal strip in a plurality of rolling steps until a desired thickness is achieved. In a reversing stand, the rolling direction is reversed with each rolling step. For determination of the thickness of the metal strip 200 after each rolling step, preferably, the rolling installation 100 has a sensor device 120. In addition, the rolling installation has a reversing reel 130 associated with the reversing stand 110 and having a reel mandrel 132. Dependent on the construction of the rolling installation and, in particular of the reversing stand 110, the rolling installation can have a second reversing reel 130', with both reels 130, 130' storing intermittently and alternatively the metal strip between separate rolling steps.

According to the invention, the rolling installation 100 further has respective winding sleeve exchange devices 140, 140' associated with respective reversing reels 130, 130'. According to the invention, the winding sleeve exchange devices serve for pushing a winding sleeve 134 (see FIG. 2) onto the reel mandrel 132, 132' before a first intermittent storage of the metal strip and for removing the winding sleeve from the reel mandrels 130, 130' between two rolling step when the thickness of the metal strip, which is determined by the sensor device 120 is still greater than the desired thickness but already smaller than a predetermined threshold thickness. The diameter of the winding sleeve lies within a range of 800-1200 mm.

Figure 2:
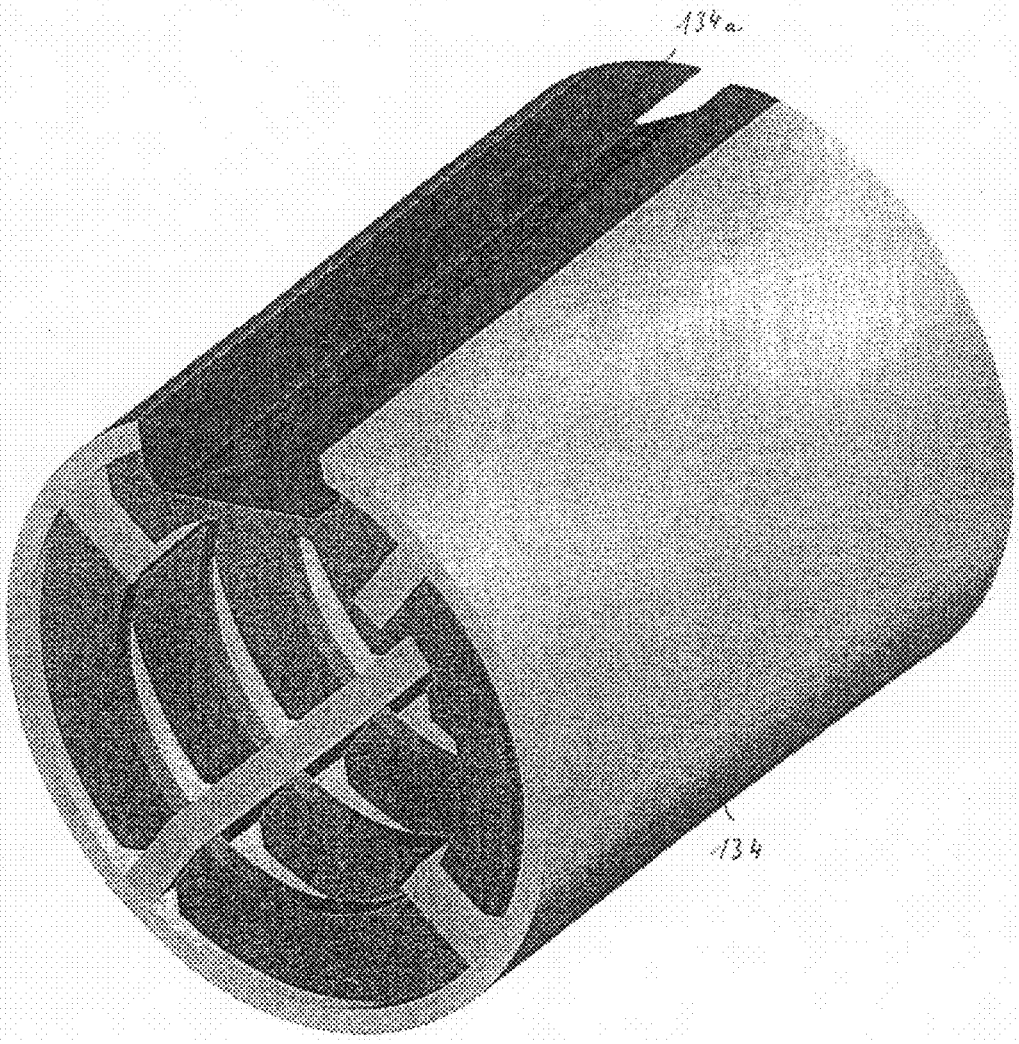
FIG. 2 shows an inventive winding sleeve.

FIG. 2 shows the inventive winding sleeve 140 which, if needed, is pushed, onto the reel mandrel 132, 132' and is secured there. It serves for increasing the minimal winding diameter and provides thereby for winding of hard and brittle materials with a relatively large thickness, without a danger of formation of cracks in this material, e.g., in metal strips. The winding sleeve has a clamping element 134*a* e.g., in form of a clamping slot for clamping an end of a metal strip to start a winding process. The clamping element 134*a* can be formed for a manual or hydraulic actuation. Preferably, it is formed for receiving metal strip with different thicknesses.

Figure 3:
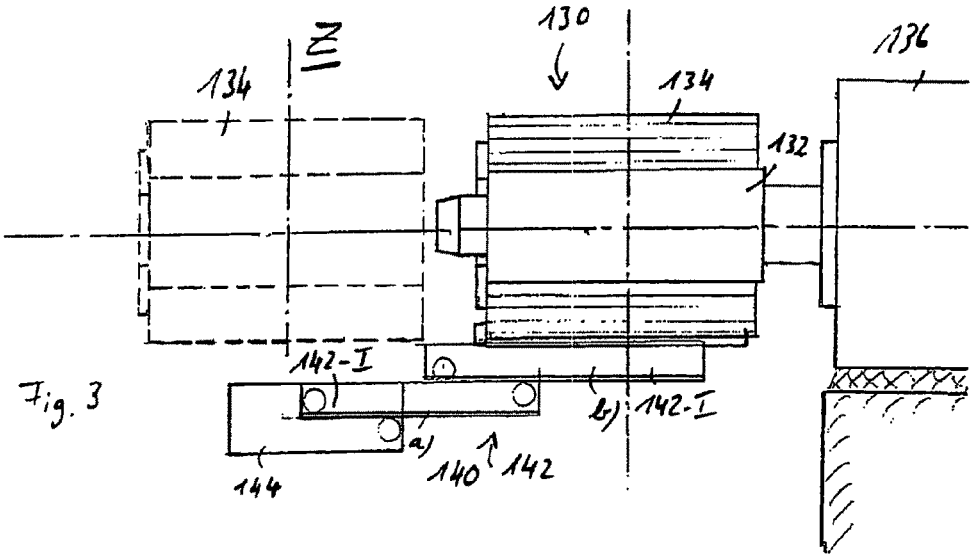
FIG. 3 shows a telescopic device as a part of an inventive winding sleeve exchange device.

FIG. 3 shows the construction and functioning of the inventive winding sleeve exchange device 140 or 140'. Both devices 140, 140' have basically the same construction and, therefore, for the simplicity sake, only one reference numeral 140 will be used. The winding sleeve exchange device 140 has, as a first part, a telescopic device 142 for coaxial displacement of the winding sleeve 134 from an intermittent position Z onto the reel mandrel 132 or from the reel mandrel back into its intermittent position Z. The telescopic device 142 has a rail 142-1 on which the winding sleeve 134 is releasably secured. The rail 142-1 is displaceably supported relative to the reel mandrel 132, thereby enabling a coaxial pushing of the winding sleeve 134 onto the reel mandrel 132 or removing the winding sleeve 134 therefrom.

FIG. 3 shows the rail 142-1 in two different displacement conditions a) and b). In order to be able graphically to show both conditions of the rail, which basically moves only translationally in one direction, the rail is shown as being spatially offset in both condition a) and b). The condition a) shows the rail 142-1 in a pulled-out condition a) relative to the reel mandrel 132, wherein its abuts against a stop 144, the winding sleeve 134 then is located in the position Z, positioned coaxially outside of the reel mandrel 132 in front thereof. Contrary to that, the condition b) symbolizes a mounted condition of the rail 142-1 that symbolizes the position of the winding sleeve 134 when it is pushed over the reel mandrel 132. The reel mandrel 132 is rotated by drive means, e.g., a motor 136 for winding or unwinding the metal strip 200.

Figure 4:
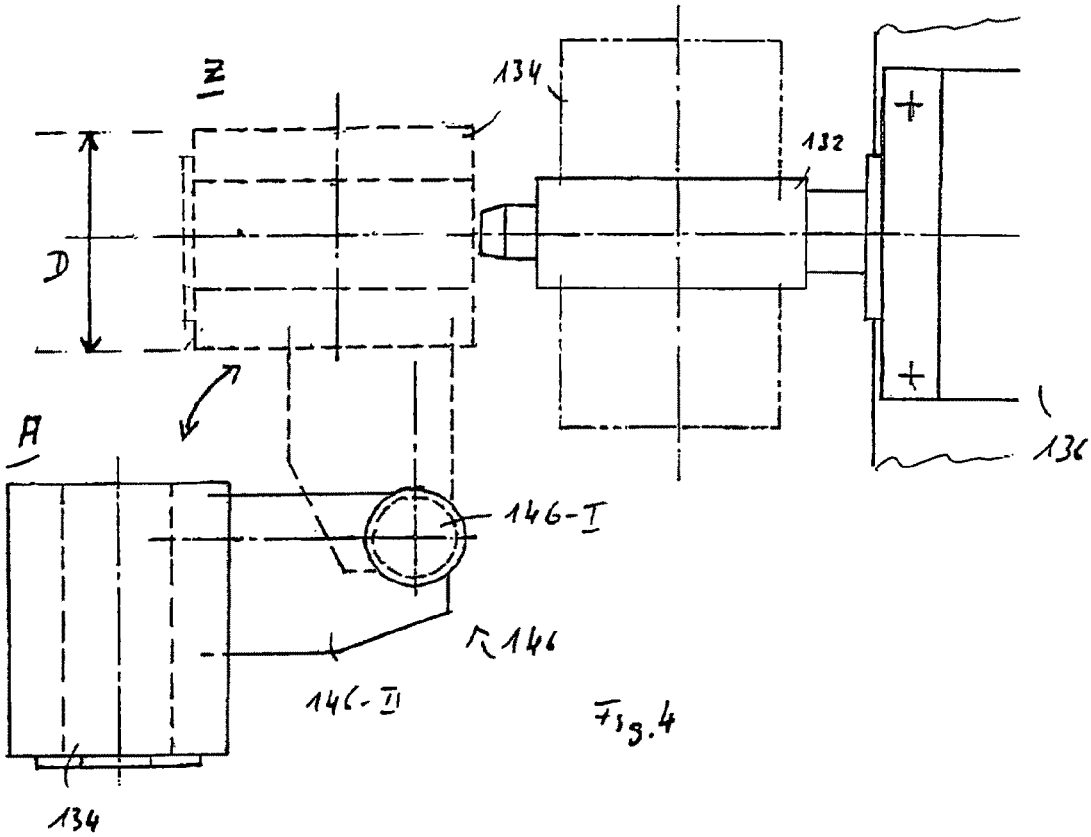
FIG. 4 shows a pivoting device as a further part of the inventive winding sleeve exchange device. shows.

While FIG. 3 descries the telescopic device 142 and its function of displacement of the winding sleeve from the intermittent position Z, FIG. 4 shows the construction and functioning of a pivoting device 146 as an optional second part of the winding sleeve exchange device 140. The pivoting device 146 serves for pivoting the winding sleeve 134 from an initial position A in the intermittent position Z. To this end, the pivoting device 146 has a stationary stand 146-I on which a support arm 146-II is pivotally supported. The winding sleeve 134 is releasably secured on the support art 146-II.

According to the invention, the winding sleeve exchange device 140 serves for pushing the winding sleeve 134 onto the reel mandrel 132 before a first intermittent storage of the metal strip after a rolling step. The winding sleeve enables, due to its larger diameter, winding of the still thick metal strip without the danger of cracks. The winding sleeve 134 remains on the reel mandrel 132 as long as the thickness of the metal strip 200 remains, after several rolling steps, above a predetermined thickness threshold. Then, the winding sleeve is either replaced with a winding sleeve having a smaller diameter, or the metal strip 200 is wound directly on the reel mandrel 132. If a small winding sleeve is used, it can be replaced by a still smaller winding sleeve as soon as a second thickness threshold, which is smaller than the first thickness threshold but greater than the desired thickness, is reached or the reel mandrel can be used directly.

The invention claimed is:

1. A rolling installation (100) for producing a metal strip, comprising a reversing stand (110) for rolling the metal strip in a plurality of steps until a desired thickness of the metal strip is reached, with a rolling direction (R) being reversed at each rolling step;

at least one reversing reel (130, 131') associated with the reversing stand (110) and having a reel mandrel (132, 132') for intermittent storing of the metal strip after separate rolling steps; and a sensor device (120) for determining the thickness of the metal strip, preferably, after each rolling step;

characterized by a winding sleeve exchange device for pushing a winding sleeve (134, 134') onto the reel mandrel (132, 132') before an intermittent storage of the metal strip and for removing the winding sleeve (134, 134') between two further rolling steps when thickness of the metal strip, which is determined by the sensor device (120)

is greater than a desired thickness but smaller than a predetermined thickness threshold.

2. A rolling installation (100) according to claim 1, characterized in that a diameter of the winding sleeve (134, 134') is adapted or is adaptable to an initial thickness of the to-be-rolled metal strip.

3. A rolling installation (100) according to claim 1, characterized in that the winding sleeve (134, 134') has a clamping element (134*a*), preferably in form of a clamping slot for clamping an end of the metal strip for starting a winding process.

4. A rolling installation according to claim 3, characterized in that the clamping device (134*a*) is actuated manually or hydraulically.

5. A rolling installation according to claim 3, characterized in that the clamping element (134*a*) is formed for receiving a metal strip having different thickness conditioned by the rolling steps.

6. A rolling installation (100) according to claim 1, characterized in that the winding sleeve exchange device has a telescopic device (142) for coaxial displacement of the winding sleeve (134, 134') from an intermittent position (Z) onto the reel mandrel (132, 132') and from the reel mandrel (132, 132') into the intermittent position (Z).

7. A rolling installation (100) according to claim 6, characterized in that the winding sleeve exchange device further has a pivoting device (146) for pivoting the winding sleeve (134, 134') from an initial position (A) into the intermittent position (Z).

8. A rolling installation (100) according to claim 1, characterized in that an outer diameter (D) of the winding sleeve (134, 134') lies in a range of 800-1200 mm.

9. A method of producing a metal strip in a rolling installation (100) having a reversing stand (110) and at least one reversing reel (130, 130') associated with the reversing stand (110) and having a reel mandrel (132, 132'), comprising the steps of: rolling the metal strip in the reversing step (110) in several rolling steps until the metal strip achieves a desired thickness, with a rolling direction (R) being reversed at each rolling step; and intermittently storing the metal strip, preferably, after each rolling step by winding it on the reversing reel (130, 130');

characterized in that as long as the thickness of the metal strip does not fall below a predetermined thickness threshold, the metal strip is wound, preferably, after each rolling step, onto a winding sleeve (134, 134'), which has been pushed onto the reel mandrel (132, 132') and is intermittently stored there; and as soon as the thickness of the metal strip achieves, as a result of carried-out rolling steps, the thickness threshold or falls below it, the empty winding sleeve (134, 134') is removed from the reel mandrel (132, 132').

10. A method according to claim 9, characterized in that after removing the winding sleeve (134, 134'), a smaller winding sleeve with a smaller diameter is pushed onto the reel mandrel (132, 132'), and the smaller winding sleeve serves as an intermittent store for the metal strip until the thickness of the metal strip falls, as a result of further carried-out rolling steps, below a further thickness threshold, which is smaller than a first thickness threshold, or its thickness corresponds to the desired thickness.

11. A method according to claim 9, characterized in that after the removal of the winding sleeve (134, 134') or the smaller winding sleeve, the metal strip is wound directly onto the reel mandrel (132, 132').

* * * * *